United States Patent [19]

Hay

[11] Patent Number: 4,839,622

[45] Date of Patent: Jun. 13, 1989

[54] TRANSFORMER CORE CLAMPING STRUCTURE

[75] Inventor: Noah D. Hay, Mukwonago, Wis.

[73] Assignee: Cooper Power Systems, Inc., Houston, Tex.

[21] Appl. No.: 252,182

[22] Filed: Sep. 30, 1988

[51] Int. Cl.[4] ..... H01F 27/02; H01F 27/26

[52] U.S. Cl. ..... 336/92; 336/210

[58] Field of Search ..... 336/90, 92, 210, 197, 336/98; 310/217

[56] References Cited

U.S. PATENT DOCUMENTS

| | | | |
|---|---|---|---|
| 1,539,878 | 6/1925 | Skinner . | |
| 1,834,898 | 12/1931 | Boyajian . | |
| 1,905,790 | 4/1933 | Brand . | |
| 2,300,536 | 11/1942 | Curry | 336/92 |
| 2,372,067 | 3/1945 | Forbes | 175/356 |
| 2,563,105 | 8/1951 | Epstein | 175/356 |
| 2,886,791 | 5/1959 | Barengoltz | 336/197 |
| 3,040,280 | 6/1962 | Wiederkehr | 336/92 |
| 3,135,939 | 6/1964 | Fortier | 336/199 |
| 3,153,215 | 10/1964 | Burkhardt et al. | 336/217 |
| 3,219,958 | 11/1965 | McKee | 336/92 X |
| 3,344,381 | 9/1967 | Koepke | 336/92 |
| 3,349,357 | 10/1967 | McNutt et al. | 336/210 |
| 3,374,453 | 3/1968 | Broverman et al. | 336/197 |
| 3,412,902 | 12/1946 | McElvain | 336/92 |
| 3,419,836 | 12/1968 | Aldridge, Jr. | 336/210 |
| 3,792,395 | 2/1974 | Michel | 336/5 |
| 3,792,397 | 2/1974 | Reinemann | 336/92 |
| 4,055,826 | 10/1977 | Franz | 336/100 |
| 4,135,172 | 1/1979 | Grimes | 336/197 |

*Primary Examiner*—Thomas J. Kozma

*Attorney, Agent, or Firm*—Michael, Best & Friedrich

[57] ABSTRACT

A transformer core and coil assembly comprising a core including first and second generally vertical, spaced-apart portions, first and second coils respectively wound around the first and second portions of the core, and a clamping structure including a generally horizontally upper member disposed above the core and the coils, a generally horizontal lower member disposed below the core and the coils, and a generally vertical end plate assembly which is disposed adjacent one of the coils, which extends between and is connected to the upper and lower members and which includes a vertically extending end plate having an upper end extending above the upper member, and the end plate assembly also including a vertically extending member having a U-shaped cross section and including a base portion parallel to and spaced from the end plate, and spaced, parallel leg portions extending from the base portion and connected to the end plate.

27 Claims, 3 Drawing Sheets

TRANSFORMER CORE CLAMPING STRUCTURE

BACKGROUD OF THE INVENTION

The invention relates to electrical transformers, and more particularly to core clamping structures for electrical transformers.

A conventional electrical transformer comprises a core including at least two spaced, vertical portions, and a core or winding assembly wound around each of the vertical portions. In some transformers, this core and coil assembly is surrounded by a core clamping structure that reduces or prevents outward movement of the coils in response to a short circuit. A conventional core clamping structure includes a generally horizontal upper member disposed above the core and the coils, a generally horizontal lower member disposed below the end plates extending between and connected to the upper and lower members. Each end plate is disposed adjacent one of the outer coils. A typical end plate is a thick steel plate, as shown in U.S. Pat. No 3,792,395.

U.S. Pat. No. 4,135,172 discloses an end plate assembly including a vertically extending plate member and U-shaped channel member welded to the plate member to give the end plate assembly a tubular configuration. Additional rigidity is provided by a plurality of ribs extending between the plate member and the chanel member.

Conventional transformers also include means for locating the core clamping structure (and thus the core and coil assembly) within a transformer tank. This means typically includes upwardly extending projections on the bottom of the tank, which projections engage the lower member of the core clamping structure and thereby prevent lateral movement of the core clamping structure relative to the bottom of the tank, and mounting brackets for securing the upper member of the core clamping structure to the tank side wall or walls.

SUMMARY OF THE INVENTION

The invention provides and improved core clamping structure, and more particularly an improved end plate assembly. The core clamping structure includes conventional upper and lower members and a pair of the improved end plate assemblies.

Each end plate assembly extends between and is connected to the upper and lower members. Each end plate assembly includes a vertically extending end plate, and a vertically extending outer member having U-shaped cross section and including a base portion parallel to and spaced from the end plate, and spaced, parallel leg portions extending from the base portion and welded to the end plate. The upper and lower members are connected to the upper and lower ends, respectively, of the outer member. More particularly, the upper and lower members are connected to the leg portions of the outer member. The length of the leg portions permits variation of the location of the upper and lower members relative to the end plate assembly and therefore provides adjustability of the overall length of the clamping structure.

The end plate assembly also includes a vertically extending inner member having a U-shaped cross section and including a base portion parallel to and spaced from the end plate, and spaced, parallel leg portions extending from the base portion of the inner member and welded to the end plate. The inner member is located between the end plate and the base portion of the outer member and between the leg portions of the outer member, and the base portion of the inner member preferably abuts the base portion of the outer member. The height of the inner member is substantially equal to the height of the outer member, and the inner and outer members are welded together at the upper and lower ends thereof. The use of two U-shaped members provides more rigidity than known prior art constructions. It should be noted that more than two U-shaped members can be used for even more rigidity.

The height of the end plate is greater than the height of the outer member so that the upper end of the end plate extends above the upper member. This permits the use of a bracket connected to the upper end of the end plate for locating the core clamping structure relative to a transformer tank. In the preferred embodiment, the end plate has thereon a horizontally and inwardly extending flange projecting from the upper end of the end plate. The flange has therein slots which receive bolts for connecting the end plate to a bracket for securing the end plate to the wall of the tank. The slots provide adjustability of the position of the bolts relative to the flange and therefore provide adjustability of the location of the end plate assembly relative to the wall of the tank. The lower end of the end plate preferably has therein a vertically extending slot adapted to receive a locating rib extending upwardly from the bottom of the tank. Preferably, the lower end of the slot is flared in order to facilitate movement of the rib into the slot.

The end plate assembly preferably also includes a pair of bottom plates mounted of the lower ends of the end plate and of the inner and outer members. The bottom plates, like the flange on the upper end of the end plate, reduce deformation of the end plate assembly during a short circuit.

Various features and advantages of the invention will become apparent to those skilled in the art upon review of the following detailed description, claims and drawings.

Figures 1, 3:
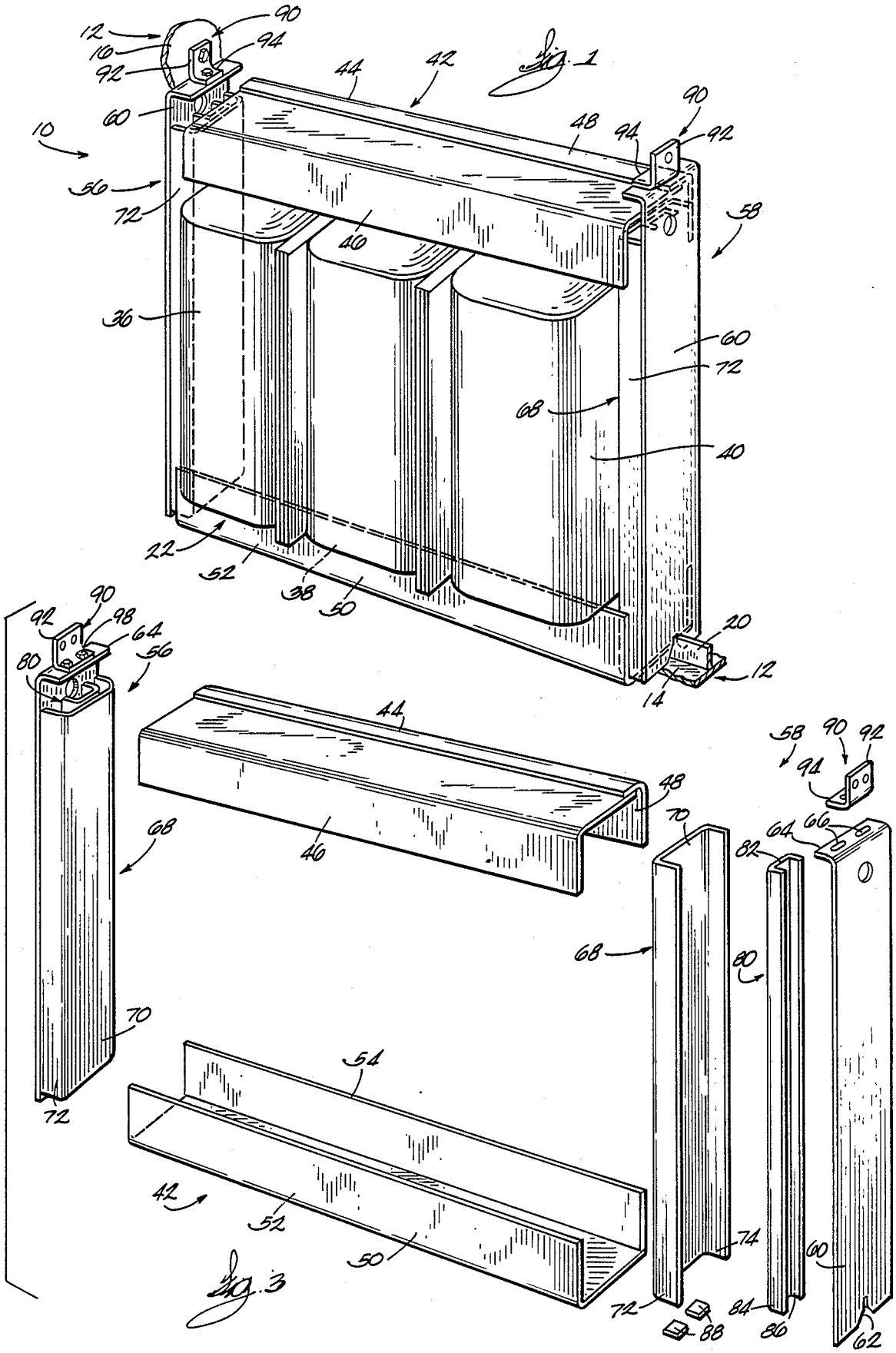
FIG. 1 is a partial perspective view of a transformer embodying the invention and comprising a core and coil assembly and a core clamping structure.
FIG. 3 is an exploded view of the core clamping structure.

Before one embodiment of the invention is explained in detail, it is to be understood that the invention in not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A transformer 10 embodying the invention is illustrated in drawings.

Figure 4:
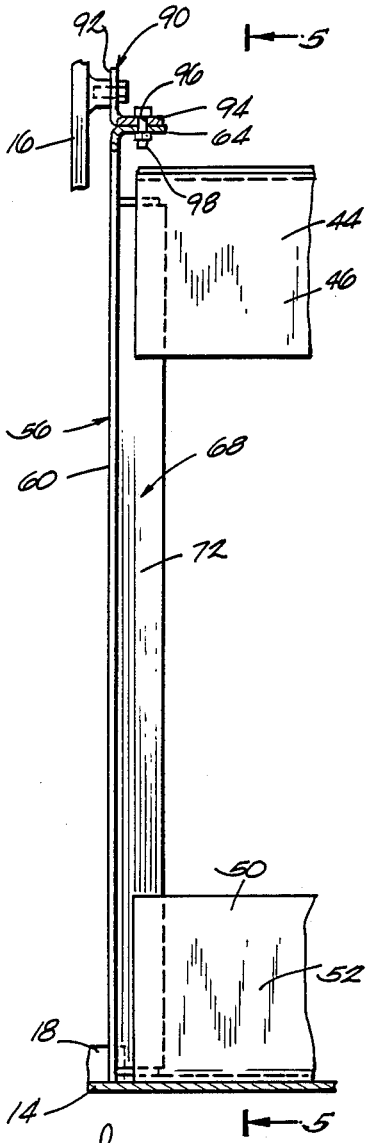
FIG. 4 is a partial side elevational view of the core clamping structure.

The transformer 10 comprises (see FIG. 1) a container or tank 12 including a bottom wall 14 (partially shown) and a side wall or walls 16 (partially shown). The botom wall 14 has thereon a pair of upwardly extending locating ribs 18 (FIG. 4) and 20 (FIG. 1), the reason for which is explained hereinafter.

Figure 2:
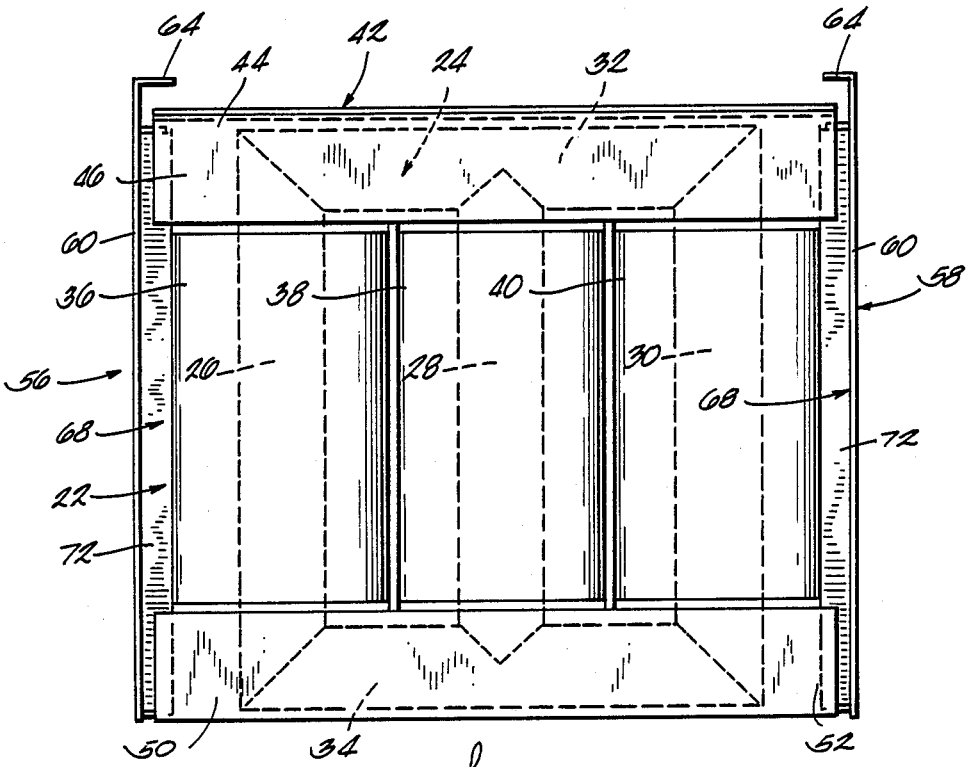
FIG. 2 is a side elevational view of the core and coil assembly and core clamping structure.

The transformer 10 also comprises a core and coil assembly 22 including (see FIG. 2) a core 24 including first, second and third generally vertical, spaced-apart portions 26, 28 and 30, respectively. The core 24 also includes an upper yoke 32 connecting the upper ends of the portions 26, 28 and 30, and a lower yoke 34 connecting the lower ends of the portions 26, 28 and 30. It should be understood that in alternative embodiments the core 24 can have a different number of vertical portions.

The core and coil assembly 22 also includes first, second and third coils 36, 38 and 40 respectively wound around the first, second and third portions 26, 28 and 30 of the core 24. The core 24 and coils 36, 38 and 40 are conventional.

The transformer 10 also comprises (see FIGS. 1–3) a core clamping structure 42 including a generally horizontal upper member 44 disposed above the core 24 and the coils 36, 38 and 40. In the preferred embodiment, the upper member 44 is formed by L-shaped portions 46 and 48. The clamping structure 42 also includes a generally horizontal lower member 50 disposed below the core 24 and the coils 36, 38 and 40. In the preferred embodiment, the lower member 50 includes an L-shaped portion 52 having perpendicular legs, and a plate portion 54 connected to one of the legs of the L-shaped portion 52.

The clamping structure 42 also includes first and second or left and right end plate assemblies 56 and 58, respectively. The left end plate assembly 56 is disposed adjacent the first or left coil 36 and extends between the left end of the upper member 44 and the left end of the lower member 50. The right end plate assembly 58 is disposed adjacent the third or right coil 40 and extends between the right end of the upper member 44 and the right end of the lower member 50. The end plate assemblies 56 and 58 are substantially identical (common elements have been given the same reference numerals) and only the right end plate assembly 58 will be described in detail.

The end plate assembly 58 includes (see FIG. 3) a vertically extending end plate 60 having a height and upper and lower ends. The lower end of the end plate 60 has therein a vertically extending slot 62 receiving the right locating rib 20 so that the clamping structure 42 is located relative to the bottom wall 14 of the tank 12. Preferably, the lower end of the slot 62 is flared in order to facilitate movement of the rib 20 into the slot 62 when the core and coil assembly 22 is lowered into the tank 12. The upper end of the end plate 60 has thereon a horizontally and inwardly extending flange 64. The flange 64 has therein a pair of slots 66, the reason for which is explained hereinafter.

The end plate assembly 58 also includes a first or outer vertically extending member 68 having a U-shaped cross section, upper and lower ends and a height less than the height of the end plate 60. The first or outer member 68 includes a base portion 70 parallel to and spaced from the end plate 60, and spaced, parallel leg portions 72 and 74 extending from the base portion 70 and connected to the end plate 60. In the preferred embodiment, the leg portions 72 and 74 are welded to the end plate 60. Futhermore, in the preferred embodiment, the L-shaped portion 46 of the upper member 44 is welded to the leg portion 72 of the outer member 68, and the L-shaped portion 48 of the upper member 44 is welded to the leg portion 74 of the outer member 68. Also, the L-shaped portion 52 of the lower member 50 is welded to the leg portion 72 of the outer member 68, and the plate portion 54 of the lower member 50 is welded to the leg portion 74 of the outer member 68. The length of the leg portions 72 and 74 permits variation of the location of the upper and lower members 44 and 50 relative to the end plate assembly 58 and therefore provides adjustability of the overall length of the clamping structure 42, The end plate assembly 58 also includes a second or inner vertically extending member 80 which is connected to the end plate 60 and which is located between the end plate 60 and the base portion 70 of the outer member 68 and between the leg portions 72 and 74 of the outer member 68. The inner member 80 has a U-shaped cross section and a height substantially equal to the height of the outer member 68. The inner member 80 includes a base portion 82 parallel to and spaced from the end plate 60, and spaced, parallel leg portions 84 and 86 extending from the base portion 82 and connected to the end plate 60. The upper end of the base portion 82 is welded to the upper end of the base portion 70 of the outer member 68, and the lower end of the base portion 82 is welded to the lower end of the base portion 70 of the outer member 68. In the preferred embodiment, the base portion 82 of the inner member 80 abuts the base portion 70 of the outer member 68.

The end plate assembly 58 also includes (see FIG. 3) a pair bottom plates 88 mounted on the lower end of the end plate 60 and the lower ends of the inner and outer members 80 and 68. Preferably, the bottom plates 88 are welded to the end plate 60 and to the inner and outer members 80 and 68.

Figure 5:
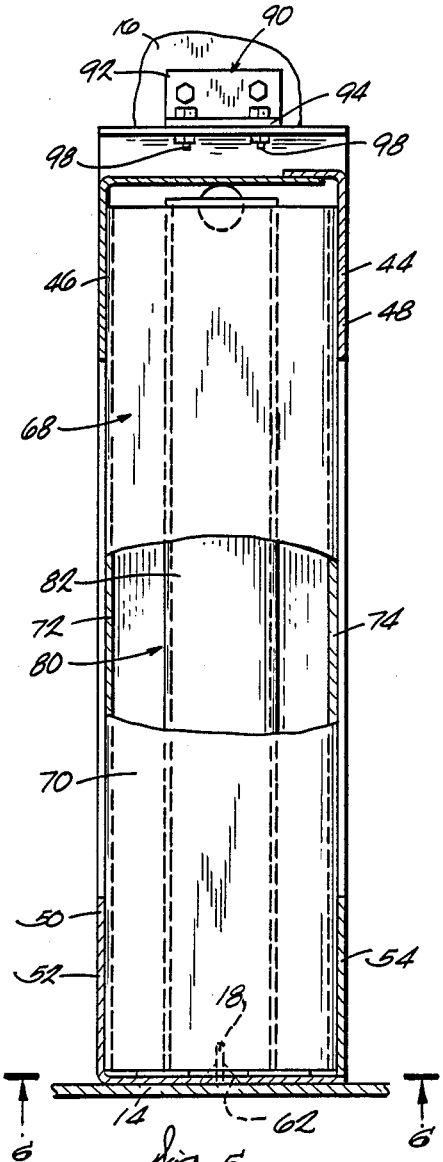
FIG. 5 is a view taken along line 5—5 in FIG. 4.
Figure 6:
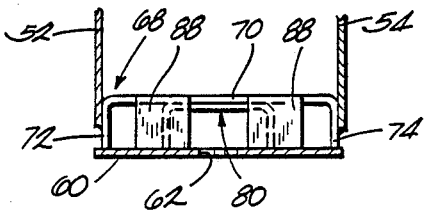
FIG. 6. is a view taken along line 6—6 in FIG. 5.

The transformer 10 also comprises means for securing the end plate assemblies 56 and 58 to the side wall or walls 16 of the tank 12 so that the clamping structure 42 is located relative to the side wall or walls 16. While various suitable securing means can be employed, in the preferred embodiment, such means includes (see FIGS. 4 and 5) an L-shaped bracket 90 having perpendicular portions 92 and 94. The portion 92 is bolted to the side wall 16, and the portion 94 has therein apertures 96 (see FIG. 4) and is secured to the flange 64 via bolts 98 extending through the apertures 96 and through the slots 66 in the flange 64. The slots 66 provide adjustability of the position of the bolts 98 relative to the flange 64 and therefore provide adjustability of the location of the end plate assembly 58 relative to the wall 16 of the tank 12.

Various features of the invention are set forth in the following claims.

I claim:

1. A transformer comprising a container including a bottom wall having thereon an upwardly extending rib, and a side wall, a core including first and second generally vertical, spaced-apart portions, first and second coils respectively wound around said first and second portions of said core, a clamping structure including a generally horizontal upper member disposed above said core and said coils, a generally horizontal lower member disposed below said core and said coils, and a generally vertical end plate assembly which is disposed adjacent one of said coils, which extends between said upper and lower members and which includes a vertically extending end plate, said end plate having a lower end which has therein a vertically extending slot receiving said rib so that said clamping structure is located relative to said bottom wall, a first vertically extending member having a U-shaped cross section and including a base portion parallel to and spaced from said end plate, and spaced, parallel leg portions extending from said base portion and connected to said end plate, said first member being connected to said upper and lower members, and a second vertically extending member which is connected to said end plate, which is located between said end plate and said base portion of said first member and between said leg portions and which has a U-shaped cross section and includes a base portion parallel to and spaced from said end plate, and spaced, parallel leg portions extending from said base portion of said second member and connected to said end plate, and means for securing said end plate assembly to said side wall so that said clamping structure is located relative to said side wall.

2. A transformer as set forth in claim 1 wherein said base portion of said second member abuts said base portion of said first member.

3. A transformer as set forth in claim 1 wherein said end plate has an upper end which extends above said upper member.

4. A transformer as set forth in claim 3 wherein said end plate includes a horizontally extending flange protecting from said upper end.

5. A transformer as set forth in claim 4 wherein said securing means secures said flange to said side wall.

6. A transformer core and coil assembly comprising a core including first and second generally vertical, spaced-apart portions, first and second coils respectively wound around said first and second portions of said core, and a clamping structure including a generally horizontally upper member disposed above said core and said coils, a generally horizontal lower member disposed below said core and said coils, and a generally vertical end plate assembly which is disposed adjacent one of said coils, which extends between and is connected to said upper and lower members and which includes a vertically extending end plate, a first vertically extending member having a U-shaped cross section and including a base portion parallel to and spaced from said end plate, and spaced, parallel leg portions extending from said base portion and connected to said end plate, and a second vertically extending member which is connected to said end plate, which is located between said end plate and said base portion of said first member and between said leg portions and which has a U-shaped cross section and includes a base portion parallel to and spaced from said end plate, and spaced, parallel leg portions extending from said base portion of said second member and connected to said end plate.

7. An assembly as set forth in claim 6 wherein said upper and lower members are connected to said first member.

8. An assembly as set forth in claim 6 wherein said base portion of said second member abuts said base portion of said first member.

9. An assembly as set forth in claim 6 wherein said end plate has an upper end which extends above said upper member.

10. An assembly as set forth in claim 9 wherein said end plate includes a horizontally extending flange projecting from said upper end.

11. An assembly as set forth in claim 10 wherein said flange includes means for securing said clamping structure to a tank.

12. An assembly as set forth in claim 6 wherein said end plate has a lower end which has therein a vertically extending slot adapted to receive a locating rib in a tank.

13. A transformer core and coil assembly comprising a core including first and second generally vertical, spaced-apart portions, first and second coils respectively wound around said first and second portions of said core, a clamping structure including a generally horizontal upper member disposed above said core and said coils, a generally horizontal lower member disposed below said core and said coils, and a generally vertical end plate assembly which is disposed adjacent one of said coils, which extends between and is connected to said upper and lower members and which includes a vertically extending end plate, a first vertically extending member having a U-shaped cross section and a height and including a base portion parallel to and spaced from said end plate, and spaced, parallel leg portions extending from said base portion and connected to said end plate, and a second vertically extending member which is connected to said end plate, which is located between said end plate and said base portion of said first member and between said leg portions and which has a height substantially equal to said height of said first member.

14. An assembly as set forth in claim 13 wherein said upper and lower members are connected to said first member.

15. An assembly as set forth in claim 13 wherein said second member has a U-shaped cross section and includes a base portion parallel to and spaced from said end plate, and spaced, parallel leg portions extending from said base portion of said second member and connected to said end plate.

16. An assembly as set forth in claim 15 wherein said base portion of said second member abuts said base portion of said first member.

17. An assembly as set forth in claim 13 wherein said end plate has an upper end which extends above said upper member.

18. An assembly as set forth in claim 17 wherein said end plate includes a horizontally extending flange projecting from said upper end.

19. An assembly as set forth in claim 18 wherein said flange includes means for securing said clamping structure to a tank.

20. An assembly as set forth in claim 13 wherein said end plate has a lower end which has therein a vertically extending slot adapted to receive a locating rib in a tank.

21. A transformer core and coil assembly comprising a core including first and second generally vertical, spaced-apart portions, first and second coils respectively wound around said first and second portions of said core, and a clamping structure including a generally horizontal upper member disposed above said core and said coils, a generally horizontal lower member disposed below said core and said coils, and a generally vertical end plate assembly which is disposed adjacent one of said coils, which extends between and is connected to said upper and lower members and which includes a vertically extending end plate having a lower end which has therein a vertically extending slot adapted to receive a locating rib in a tank, and said end plate assembly also including a vertically extending member having a U-shaped cross section and including a base portion parallel to and spaced from said end plate, and spaced, parallel leg portions extending from said base portion and connected to said end plate.

22. An assembly as set forth in claim 21 wherein said upper and lower members are connected to said first member.

23. An assembly as set forth in claim 21 wherein said second member has a U-shaped cross section and includes a base portion parallel to and spaced from said end plate, and spaced, parallel leg portions extending from said base portion of said second member and connected to said end plate.

24. An assembly as set forth in claim 23 wherein said base portion of said second member abuts said base portion of said first member.

25. An assembly as set forth in claim 21 wherein said end plate has an upper end which extends above said upper member.

26. An assembly as set forth in claim 25 wherein said end plate includes a horizontally extending flange projecting from said upper end.

27. An assembly as set forth in claim 26 wherein said flange includes means for securing said clamping structure to a tank.

* * * * *

UNITED STATES PATENT AND TRADEMARK OFFICE

CERTIFICATE OF CORRECTION

PATENT NO. : 4,839,622

DATED : June 13, 1989

INVENTOR(S) : Noah D. Hay

It is certified that error appears in the above-identified patent and that said Letters Patent is hereby corrected as shown below:

Column 1, line 18, after "the" insert --core and the coils, and a pair of generally vertical--.

Column 1, line 21, delete "No" and insert --No.--.

Column 1, line 25, before "U-shaped" insert --a--.

Column 1, line 28, delete "chanel" and insert --channel--.

Column 1, line 43, delete "and" and insert --an--.

Column 2, line 35, delete "of" and insert --on--.(1st occurrence)

Column 2, line 59, delete "in" and insert --is--.(2nd occurrence)

Column 4, line 39, after "pair" insert --of--.

Signed and Sealed this

Seventeenth Day of July, 1990

*Attest:*

HARRY F. MANBECK, JR.

*Attesting Officer*

*Commissioner of Patents and Trademarks*